US008104785B2

(12) United States Patent
Hutchinson et al.

(10) Patent No.: US 8,104,785 B2
(45) Date of Patent: Jan. 31, 2012

(54) BINDING FOR SKI

(76) Inventors: Ned Hutchinson, Wilson, WY (US); Jason Daigle, Jackson, WY (US)

( * ) Notice: Subject to any disclaimer, the term of this patent is extended or adjusted under 35 U.S.C. 154(b) by 1140 days.

(21) Appl. No.: 11/855,871

(22) Filed: Sep. 14, 2007

(65) Prior Publication Data

US 2009/0072519 A1 Mar. 19, 2009

(51) Int. Cl.
*A63C 9/00* (2006.01)

(52) U.S. Cl. ..... 280/614; 280/617

(58) Field of Classification Search ..... 280/601, 280/607, 611, 613, 614, 615, 617, 618, 626
See application file for complete search history.

(56) References Cited

U.S. PATENT DOCUMENTS 1,593,937 A * 7/1926 Hall ..... 280/618
3,731,943 A * 5/1973 Wilkes ..... 280/613
4,002,354 A * 1/1977 Ramer ..... 280/614
4,157,191 A * 6/1979 Ramer ..... 280/614
4,230,338 A * 10/1980 Weigl et al. ..... 280/618
4,500,108 A 2/1985 Johnson, III
4,674,766 A * 6/1987 Ramer ..... 280/614
5,242,188 A 9/1993 Bigler et al.
5,560,633 A * 10/1996 McGowan ..... 280/614
2001/0045726 A1* 11/2001 Pedersen et al. ..... 280/611
2006/0119076 A1* 6/2006 Pupko ..... 280/607

* cited by examiner

*Primary Examiner* — J. Allen Shriver, II
*Assistant Examiner* — Bridget Avery
(74) *Attorney, Agent, or Firm* — Holland & Hart LLP

(57) ABSTRACT

A system for alpine touring, a low-profile, selectively pivotal riser, and a method of releasably locking a ski boot heel. In an embodiment, the system for alpine touring includes a pair of skis; a pair of low-profile, selectively pivotal risers, and a pair of alpine ski boot bindings. In one embodiment, the riser includes an alpine binding attachment plate, a first anchor portion for pivotally attaching the riser thereto; and a second anchor portion for selectively attaching the riser thereto.

14 Claims, 17 Drawing Sheets

BINDING FOR SKI

BACKGROUND

Ski randonnée or alpine touring (AT) is generally a form of backcountry skiing. Randonnée skis and bindings typically allow a skier's heel to release and pivot at the toe for periods of uphill travel, and are able to lock down the heel for downhill travel. Ski randonée generally differs from cross-country skiing equipment and more robust telemark equipment in that for cross-country and telemark ski the skier's heel also is free on the descent, randonée is different than alpine touring as alpine touring skiers lock down their heels at all times.

Ski touring may be carried out using a variety of equipment. For example, nordic ski touring is skiing with bindings that leave the heels relatively free all the time. Nordic skis may be narrow and edgeless cross-country types for groomed trails with boots that resemble soft shoes. Nordic skis may have fish-scale bases which allow for very natural, seamless travel up and over hilly terrain due to the lack of a need to change modes for ascending and descending.

Telemark skis may be used for steep backcountry terrain or within alpine ski-areas. Telemark gear, like AT equipment, is frequently used for ski touring in that additional control is provided on a descent. Some telemark bindings have an AT-style pivot to allow forward rotation of the boot while touring. The pivot may be locked for downhill skiing (much like an AT binding). However, the heel of the boot may still be raised off the ski.

Alpine touring or randonnée equipment is designed for ski touring in steep terrain. A special alpine touring binding is typically used in which the heel may be clipped down for more support when skiing downhill, and released to swing resistance-free from the toe when climbing.

Alpine modified equipment may also be used for ski touring. Alpine skiing equipment may be modified with the addition of a removable binding insert. This insert allows free heel swing on ascents. The advantage of this set up is maximum support and safety release at higher speeds, in more difficult snow conditions and on steeper slopes as well as no new ski equipment needs other than the insert. Some of the major downside of this equipment arrangement include that it is very heavy, stiff, unwieldy, cumbersome, and uncomfortable on uphill climbs and long traverses.

Another medication to skiing equipment includes the use of risers. Risers typically are interspersed between the ski and the binding such that the binding is raised from the ski. Using a riser provides improvement in edge control, generically referred to as edging, and the like.

Moreover, the presently available choices to skiers is to use cumbersome equipment. Thus, it would be desirous to provide equipment with an ease of use that may allow skiers who commonly rely on lift service but also ski tour to be capable of using lift services without owning a second pair of skis.

Against this background, it would be desirous to provide an improved apparatus for a ski randonée or alpine touring ski.

SUMMARY OF THE INVENTION

In an embodiment, there is provided a system for alpine touring, the system comprising: a pair of skis having a top surface and a bottom surface in opposition to one another, and the bottom surface for skiing on a snow surface; a pair of low-profile, selectively pivotal risers, each one of the low-profile, selectively pivotal risers comprising: an alpine binding attachment plate having a top side and a bottom side in opposition to one another, a toe end and a heel end in opposition to one another, the top side providing an area for attaching an alpine ski boot binding thereon, a first attachment portion toward the toe end, and a second attachment portion toward the heel end; a first anchor portion for pivotally attaching the first attachment portion thereto, and the first anchor portion in attachment with the top surface of one of the pair of skis; and a second anchor portion for selectively attaching the second attachment portion thereto, and the second anchor portion in attachment with the top surface of one of the pair of skis; and a pair of alpine ski boot bindings, each one of the alpine ski boot bindings attaching to the top side of the alpine binding attachment plate of one of the pair of low-profile, selectively pivotal risers.

In another embodiment, there is provided a low-profile, selectively pivotal riser, comprising an alpine binding attachment plate having a top side and a bottom side in opposition to one another, a toe end and a heel end in opposition to one another, the top side providing an area for attaching an alpine ski boot binding thereon, a first attachment portion toward the toe end, and a second attachment portion toward the heel end; a first anchor portion for pivotally attaching the first attachment portion thereto, and the first anchor portion configured for attachment with a ski; and a second anchor portion for selectively attaching the second attachment portion thereto, and the second anchor portion configured for attachment with the ski.

In yet another embodiment, there is provided a method of releasably locking a ski boot heel, the method comprising inserting a ski boot into an alpine ski boot binding mounted to an alpine binding attachment plate; removing a locking device, which includes, for example, a pin, extending through one or more passageways extending through a first anchor portion in attachment with a ski to allow movement of a first attachment portion of the alpine binding attachment plate; adjusting the alpine binding attachment plate to disengage a second attachment portion of the alpine binding attachment plate from a second anchor portion in attachment with the ski; inserting the locking device in one or more passageways extending through the first anchor portion to position the second attachment portion and the second anchor portion in a disengaged relationship to one another so as to allow the alpine binding attachment plate to pivot at the first attachment portion with respect to the ski; removing the pin extending through the another one of the at least two passageways; adjusting the alpine binding attachment plate to engage the second attachment portion and the second anchor portion with one another; and inserting the pin into the one of the at least two passageways extending through the first anchor portion to position the second attachment portion and the second anchor portion in a disengaged relationship to one another so as to prevent the alpine binding attachment plate from pivoting at the first attachment portion with respect to the ski.

Other embodiments are also disclosed.

BRIEF DESCRIPTION OF THE DRAWINGS

Illustrative embodiments of the invention are illustrated in the drawings, in which.

DETAILED DESCRIPTION

Figure 1:
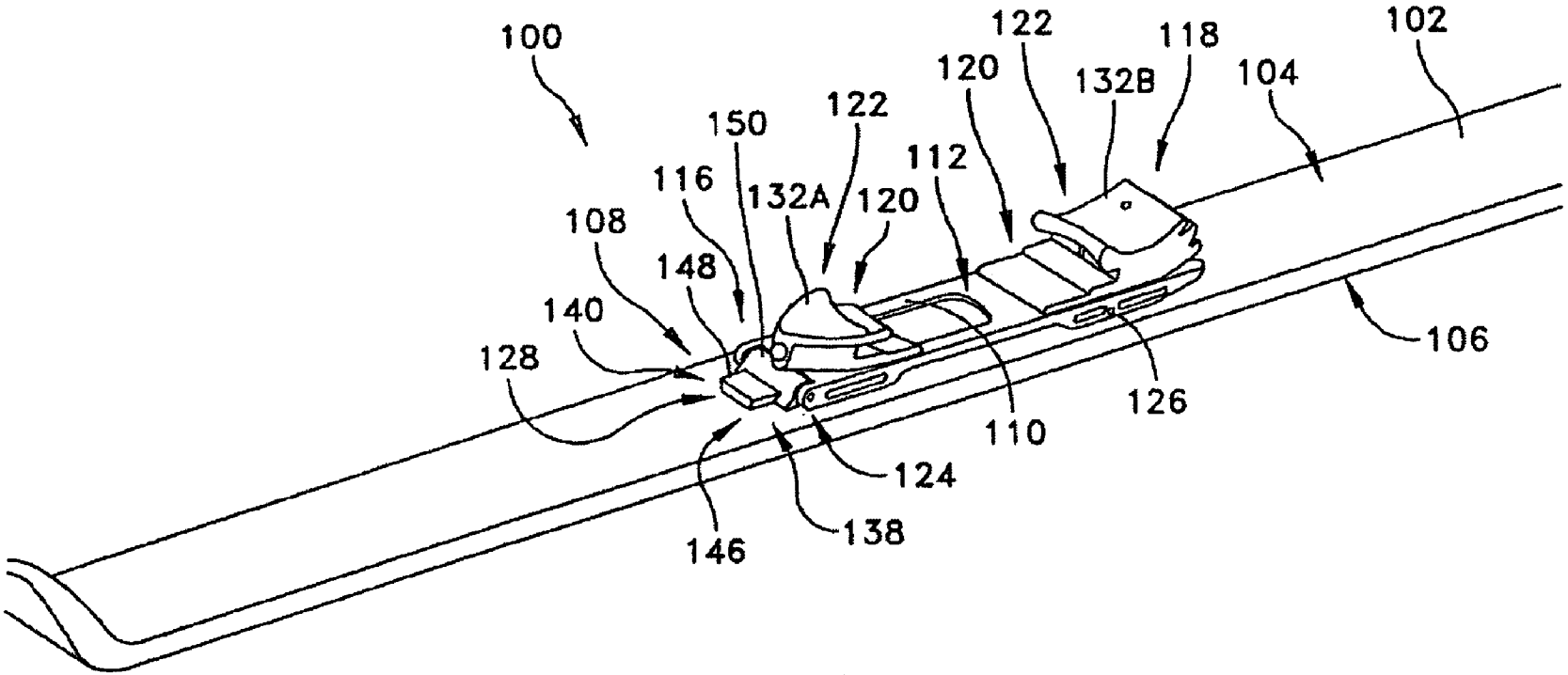
FIGS. 1-3 illustrate an exemplary embodiment of a system for alpine touring with a low-profile, selectively pivotal ski riser mounted on a ski, and an alpine ski boot binding mounted to the low-profile, selectively pivotal ski riser.
Figure 2:
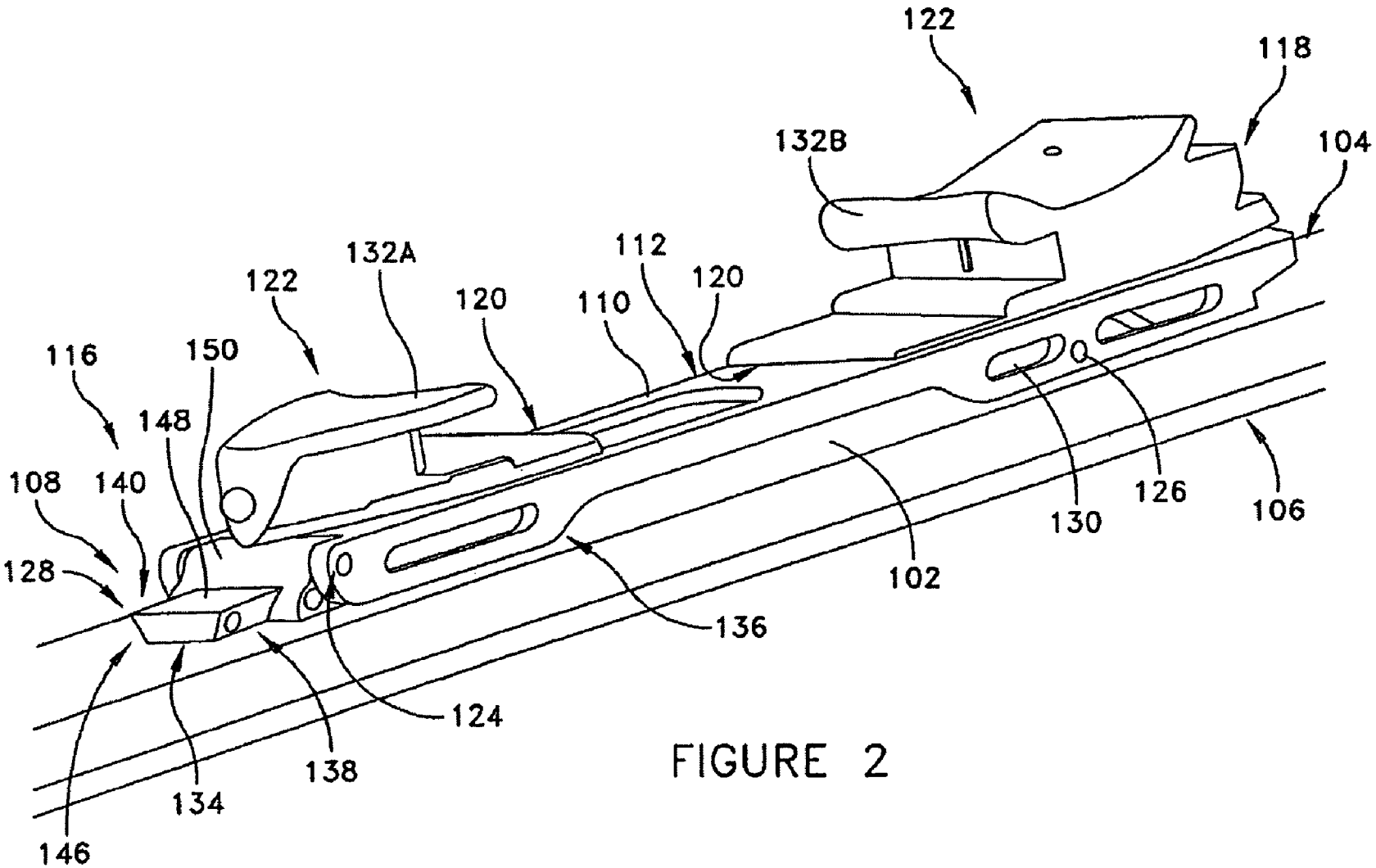
Figure 3:
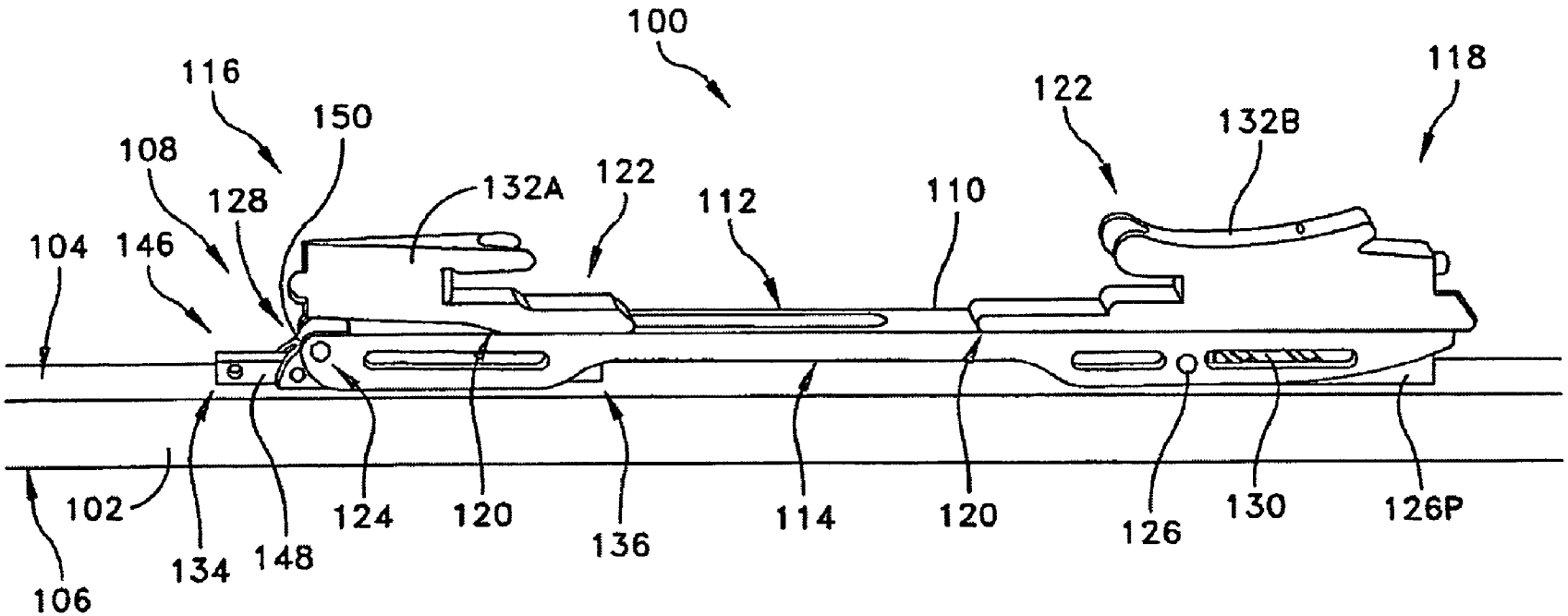

Referring to FIGS. 1-3, there is shown an exemplary embodiment of a system 100 for alpine touring. System 100 may include one ski, more typically, a pair of skis 102 having a top surface 104 and a bottom surface 106 in opposition to one another. Typically, bottom surface 106 may be configured for skiing on a snow surface. While frequently described with relation to alpine equipment or style, the ski, foot wear, binding, and the like may be used for or with equipment adapted to for randonnée, mountaineering, hybrid or the like uses as those terms are commonly understood in the art. Moreover, the technology of the present application may specifically be used with Garmont Adrenalin™ boots, which Is available from Garmont Sri of Italy.

Figure 9:
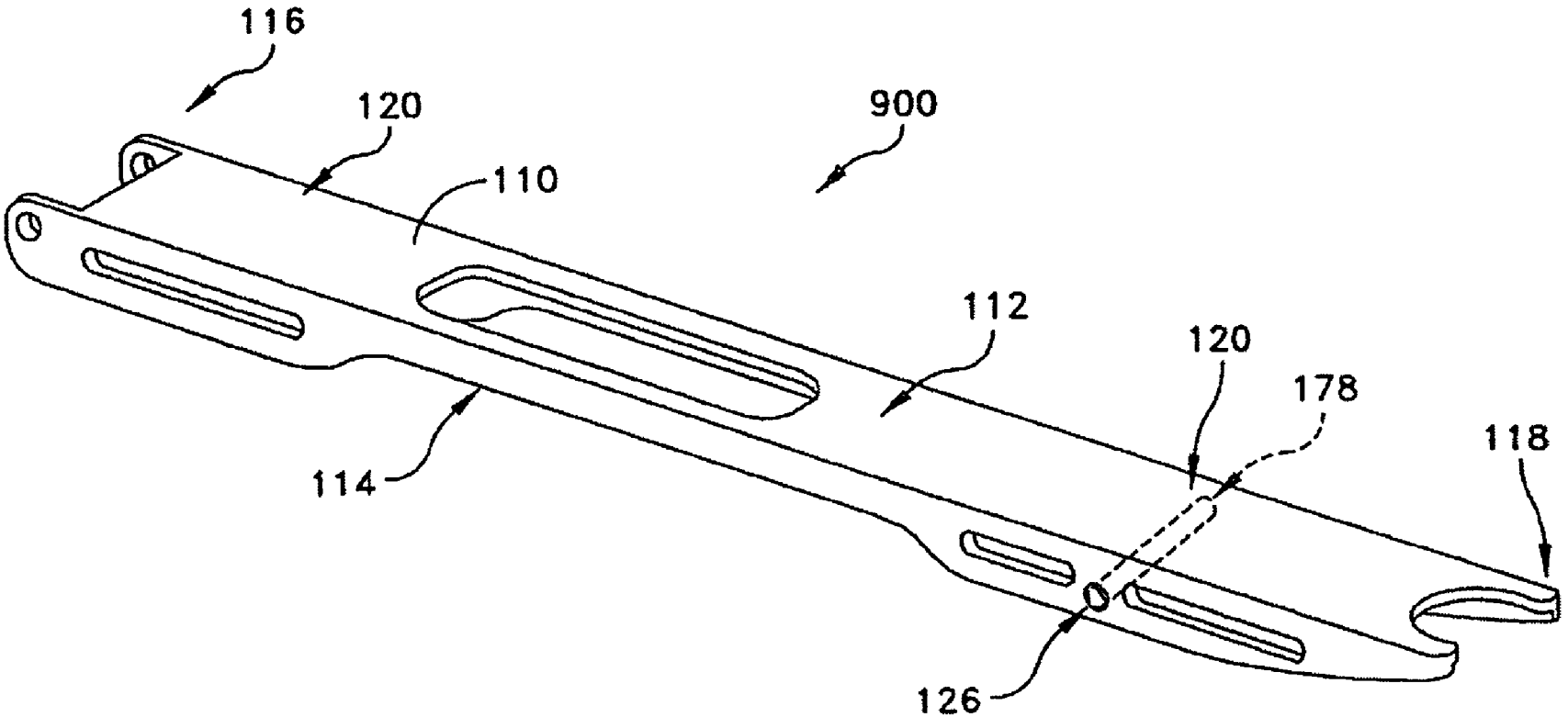
FIG. 9 illustrates another view of the alpine binding attachment plate.

System 100 may include a pair of selectively pivotal risers 108. Each one of the selectively pivotal risers 108 may include a binding attachment plate 110 (FIG. 9) having a top side 112 and a bottom side 114 in opposition to one another. The selectively pivotal risers may be low profile. A toe end 116 and a heel end 118 of riser 108 are in opposition to one another. An area 120 is provided on top side 112 for attaching a ski boot binding 122 to each riser 108. While described as separately attaching a binding 122 as is common, binding 122 may be integrated into the risers. A first attachment portion 124 may be provided toward toe end 116 of riser 108. A second attachment portion 126 may be provided toward heel end 118 of riser 108.

A first anchor portion 128 may be provided for pivotal attachment to first attachment portion 124 of alpine binding attachment plate 110. First anchor portion 128 may be attached to top surface 104 of ski 102. While described as attached or mounted to the top surface, the use of the term attached or mounted should be construed broadly to include Integrating the anchor portions (and the associated risers) into the top surface of the skis.

A second anchor portion 130 may be provided for selective attachment to second attachment portion 126 of alpine binding attachment plate 110. Second anchor portion 130 may be attached to top surface 104 of ski 102. While described as attached or mounted to the top surface, the use of the term attached or mounted should be construed broadly to include integrating the anchor portions (and the associated risers) into the top surface of the skis.

The alpine ski boot binding 122 may be provided for each ski 102. Each alpine ski boot binding 122 may be attached to the top side 112 of alpine binding attachment plate 110 of one of the pair of low-profile, selectively pivotal risers 108. While described as attached, the bindings and risers may be single units. In other words, the binding and riser may be a single unit. Moreover, the risers may be integrated into the top side of the ski.

In an embodiment, alpine binding attachment plate 110 may be configured for attaching a toe portion 132A of alpine ski boot binding 122 on alpine binding plate 110 toward toe end 116. Alpine binding attachment plate 110 also may be configured for attaching a heel portion 132B of alpine ski boot binding 122 on alpine binding attachment plate 110 toward heel end 118.

In an embodiment, first anchor portion 128 and second anchor portion 130 are separate components from one another so as to allow selective mounting of the first anchor portion 128 and the second anchor portion 130 on the ski 102 with respect to one another. The first attachment portion 124 includes a pair of passageways 124*p* for retaining a shaft 144 (FIG. 7) to pivotally attach first attachment portion 124 to allow the first anchor portion 128. Second attachment portion 126 includes a crossbar 130*c* for selective engagement with the second anchor portion 130.

Figure 4:
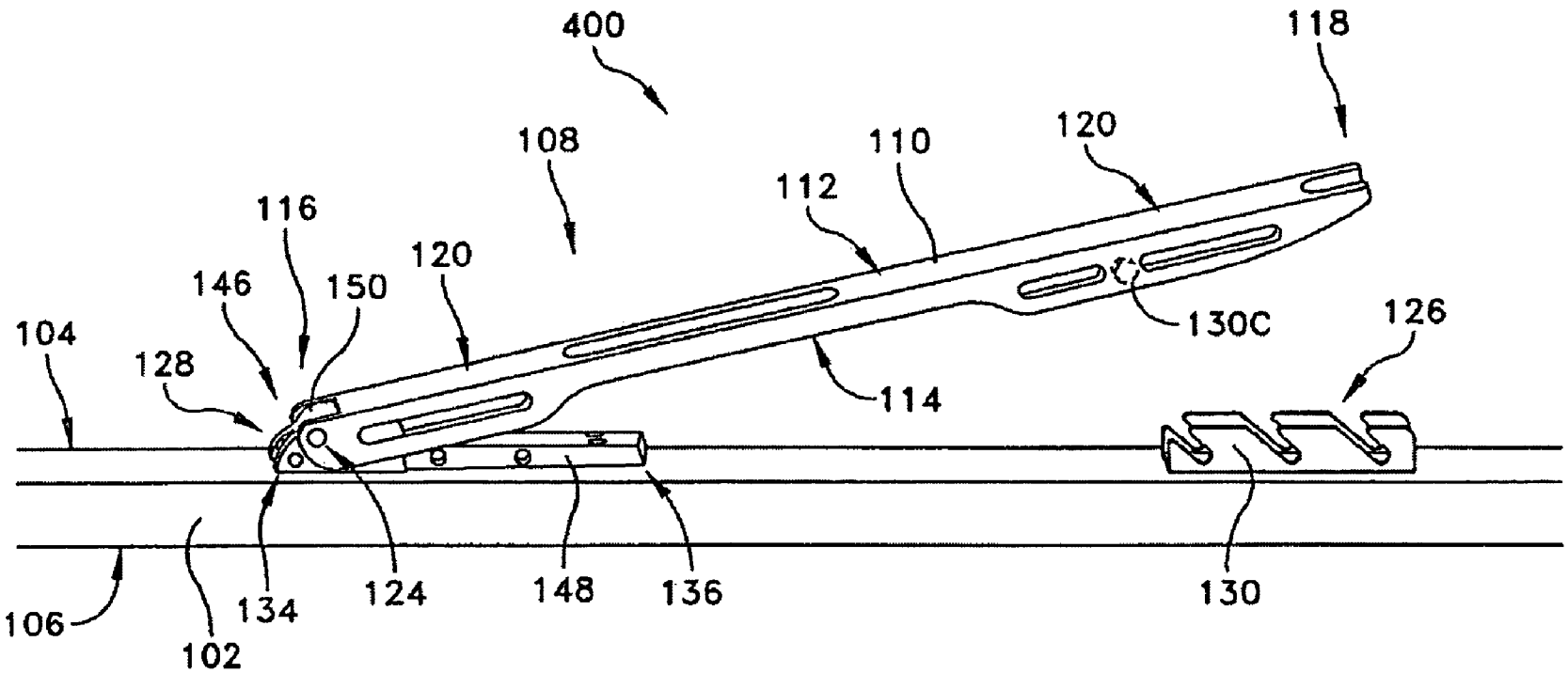
FIGS. 4-6 illustrate the system shown in FIGS. 1-3 without the alpine ski boot binding.
Figure 5:
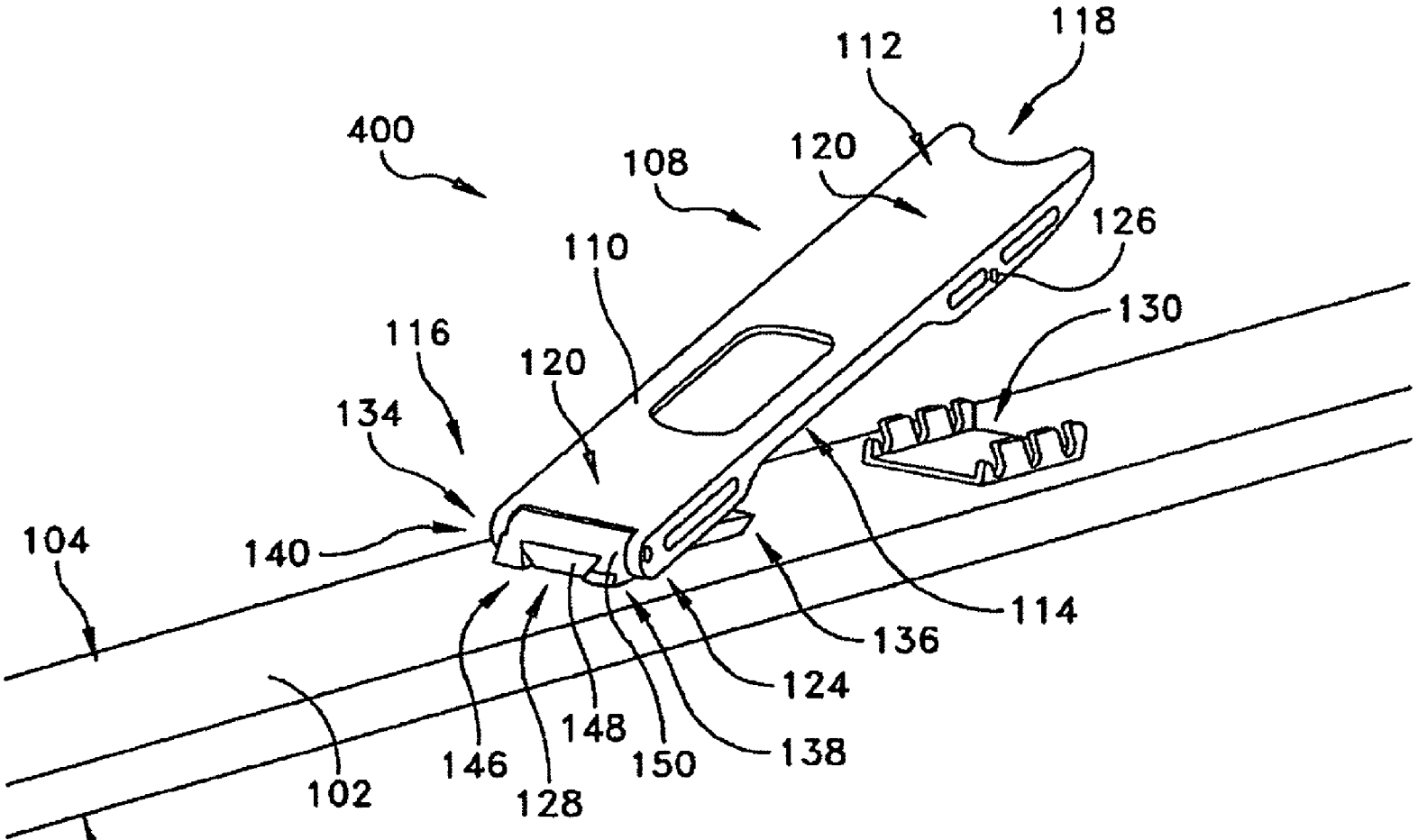
Figure 6:
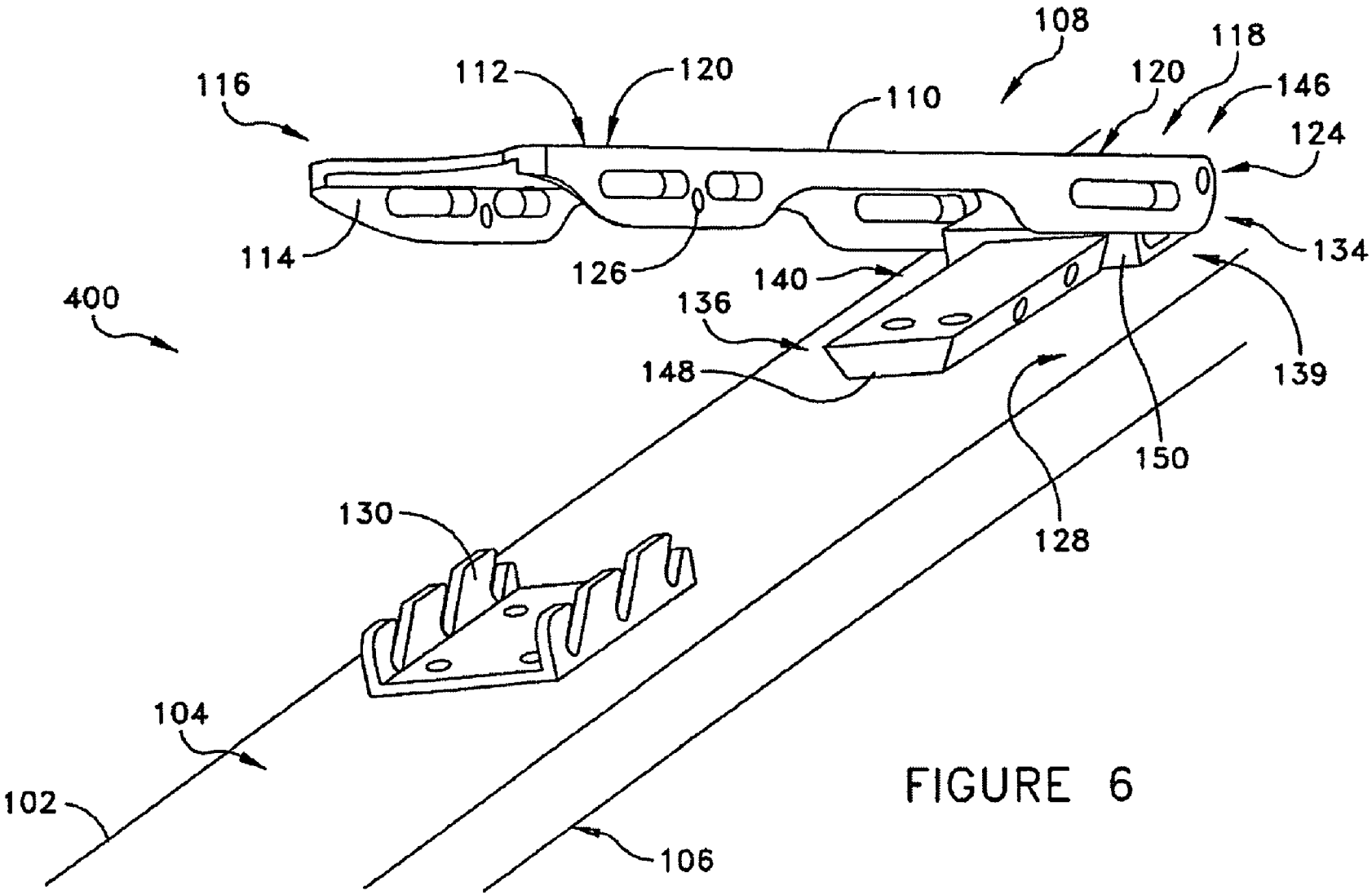

Looking at FIGS. 4-6, there is shown system 400 comprising selectively pivotal risers 108 without alpine ski boot binding 122. Ski 102 is removed from FIGS. 4-6 for easy reference and explanation. As explained above, first anchor portion 128 may be positioned on ski 102 for selective engagement with first attachment portion 124 of alpine binding attachment plate 110. A toe end 134 and a heel end 136 of first anchor portion 128 are shown in opposition to one another. Also, there is shown a left side 138 and a right side 140 in opposition to one another. First anchor portion 128 may form an opening 142 between left side 138 and right side 140. This opening 142 may be configured for retaining a shaft 144. This configuration allows pivotal attachment of first attachment portion 124 of alpine binding attachment plate 110 to first anchor portion 128.

Figure 7:
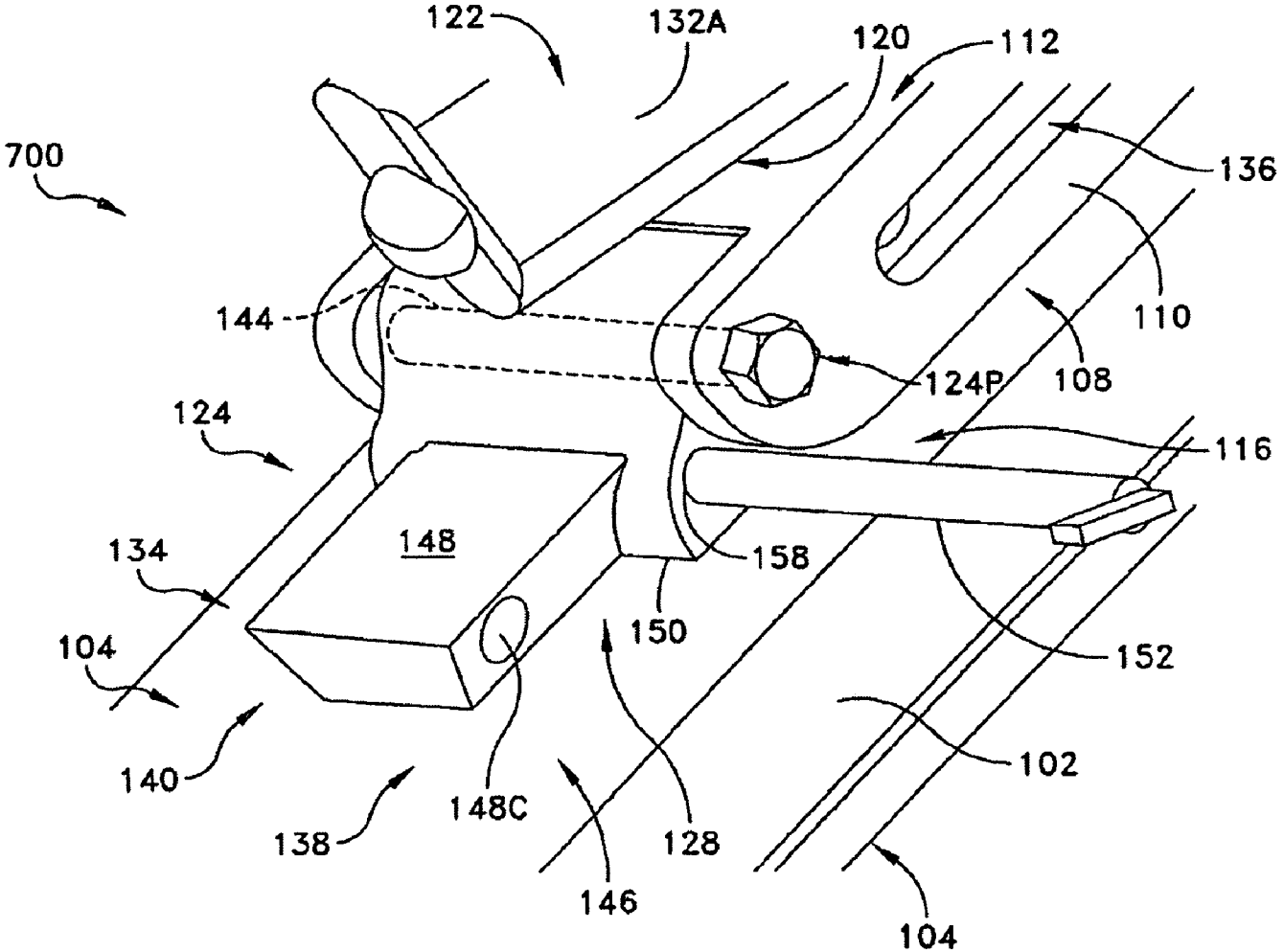
FIG. 7 illustrates a toe end of the system shown in FIGS. 1-6, Including one anchor portion having an anchor plate, a slide, and a fixation device, an alpine binding attachment plate In attachment to the anchor portion, and an alpine ski boot binding in attachment to the alpine binding attachment plate.

Referring to FIG. 7, and in one embodiment, there is shown a portion 700 at toe end 134. A horizontal adjustment mechanism 146 may be provided for selectively adjusting the horizontal position of second anchor portion 130 with respect to second attachment portion 126. This permits selective positioning of alpine binding plate 110 with respect to ski 102.

Figure 10:
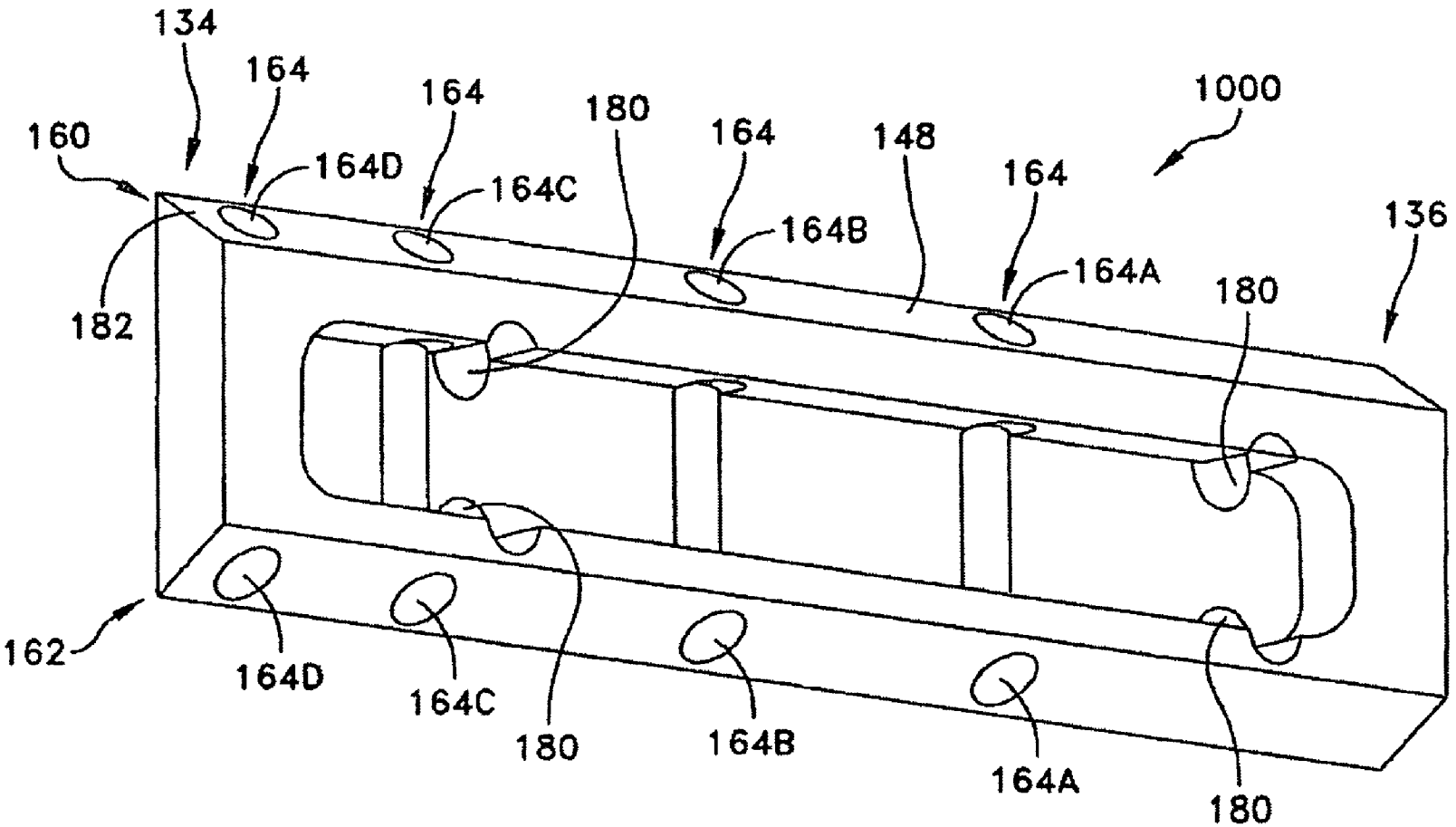
FIGS. 10 and 11 illustrate additional views of the anchor plate of the anchor portion for placement at the toe end of the system.
Figure 11:
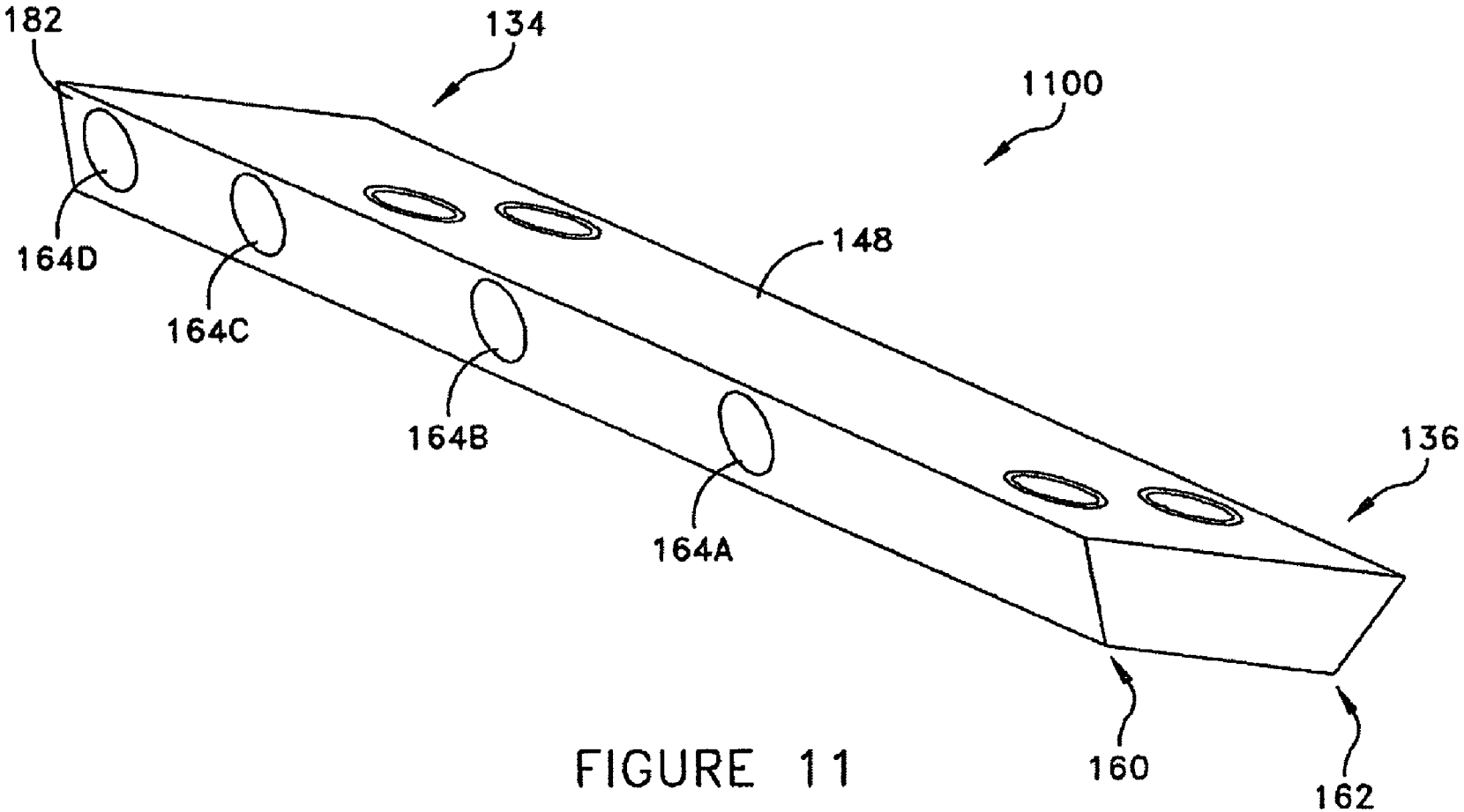
Figure 12:
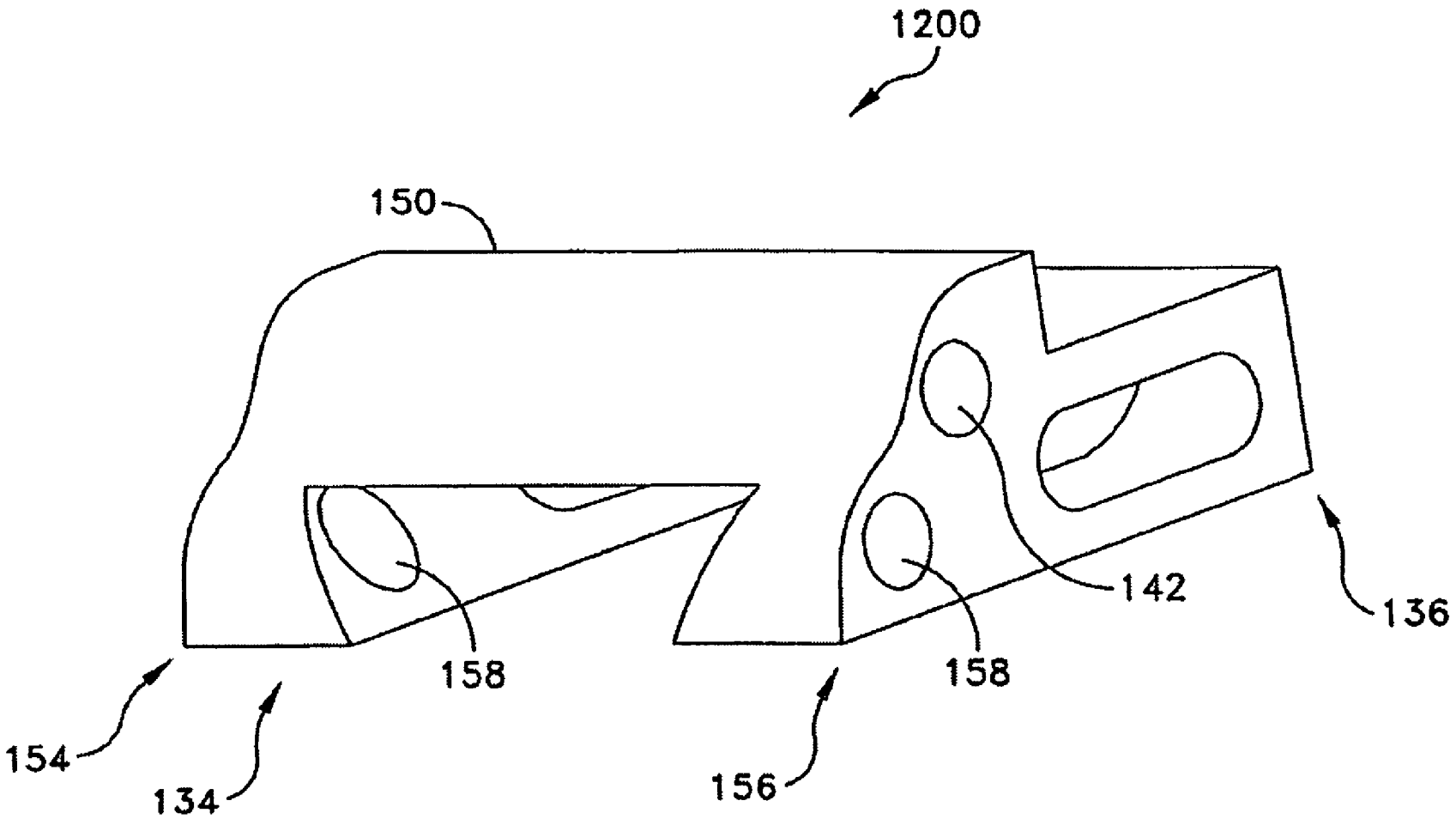
FIGS. 12 and 13 illustrate additional views of the slider portion of the anchor portion for placement at the toe end of the system.
Figure 13:
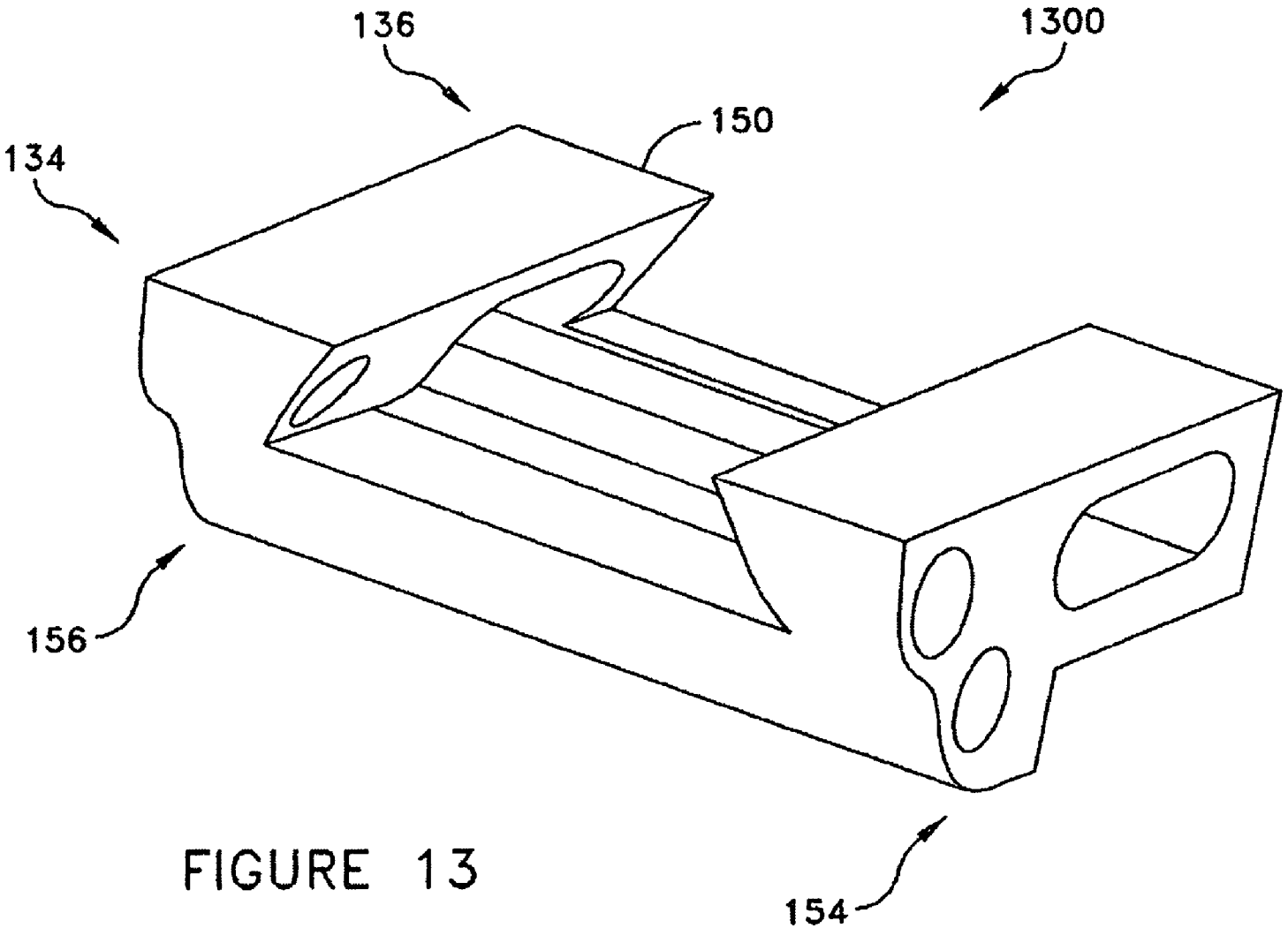
Figure 14:
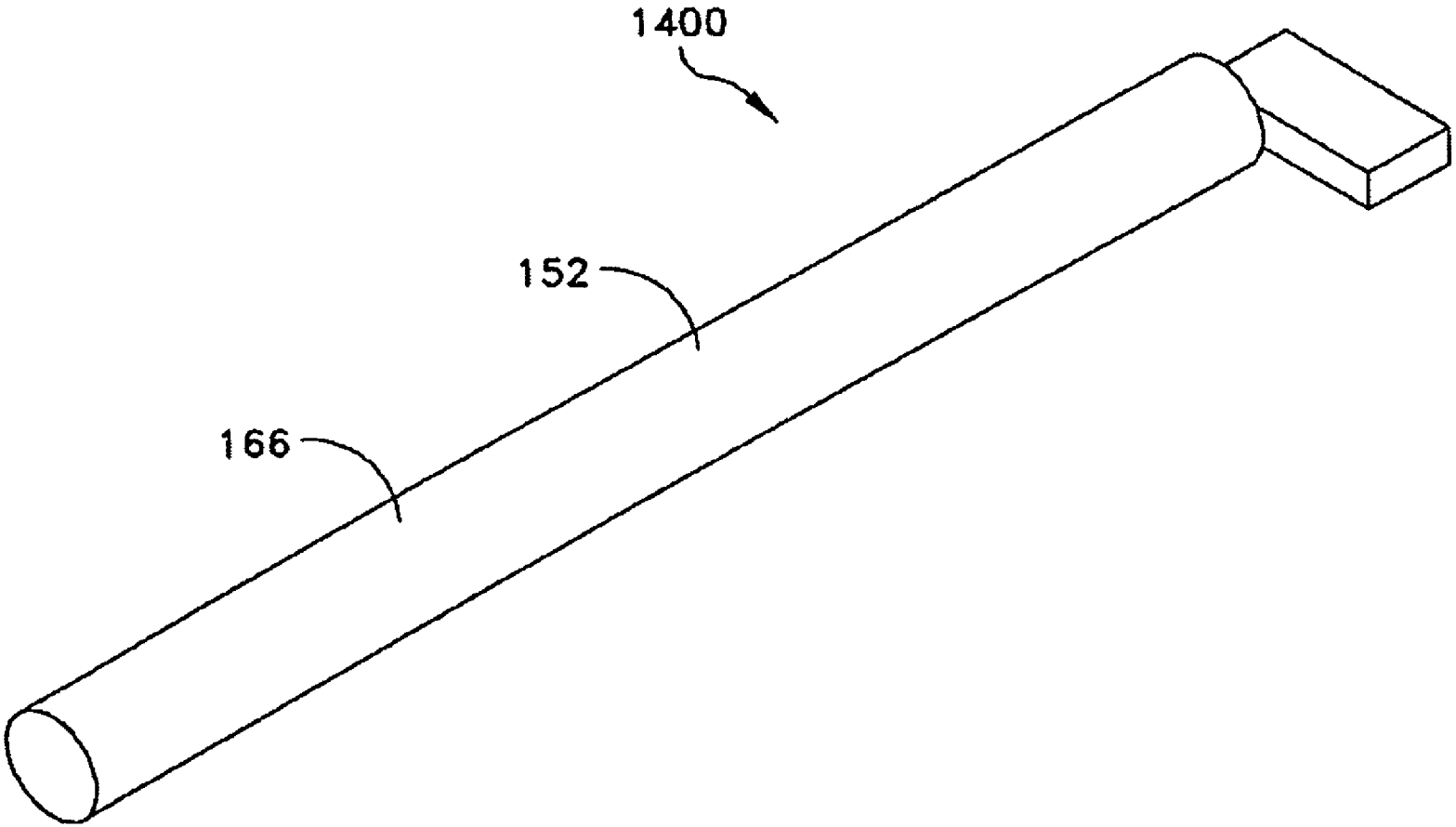
FIG. 14 illustrates another view of the fixation device of the anchor portion for placement at the toe end of the system.

Horizontal adjustment mechanism 146 may include an anchor plate 148 (FIGS. 10 and 11), a slider 150 (FIGS. 12 and 13), and a fixation device 152 (FIG. 14). Anchor plate 148 attaches to ski 102. As defined above, attaches should be construed broadly to Include a separate component coupled to ski 102 or integrated into the top side of ski 102. Anchor plate 148 may be configured with one or a number of channels 148*c* are separately alignable with passageway 158 in slider 150 such that anchor plate 148 may slide along slider 150 and locked in a desired position. Slider 150 may be pivotally attached to the alpine binding attachment plate 110 through opening 142 and shaft 144. Fixation device 152 selectively positions anchor plate 148 and slider 150 with respect to one another by extending through channels 148*c* and passageway 158.

Figure 8:
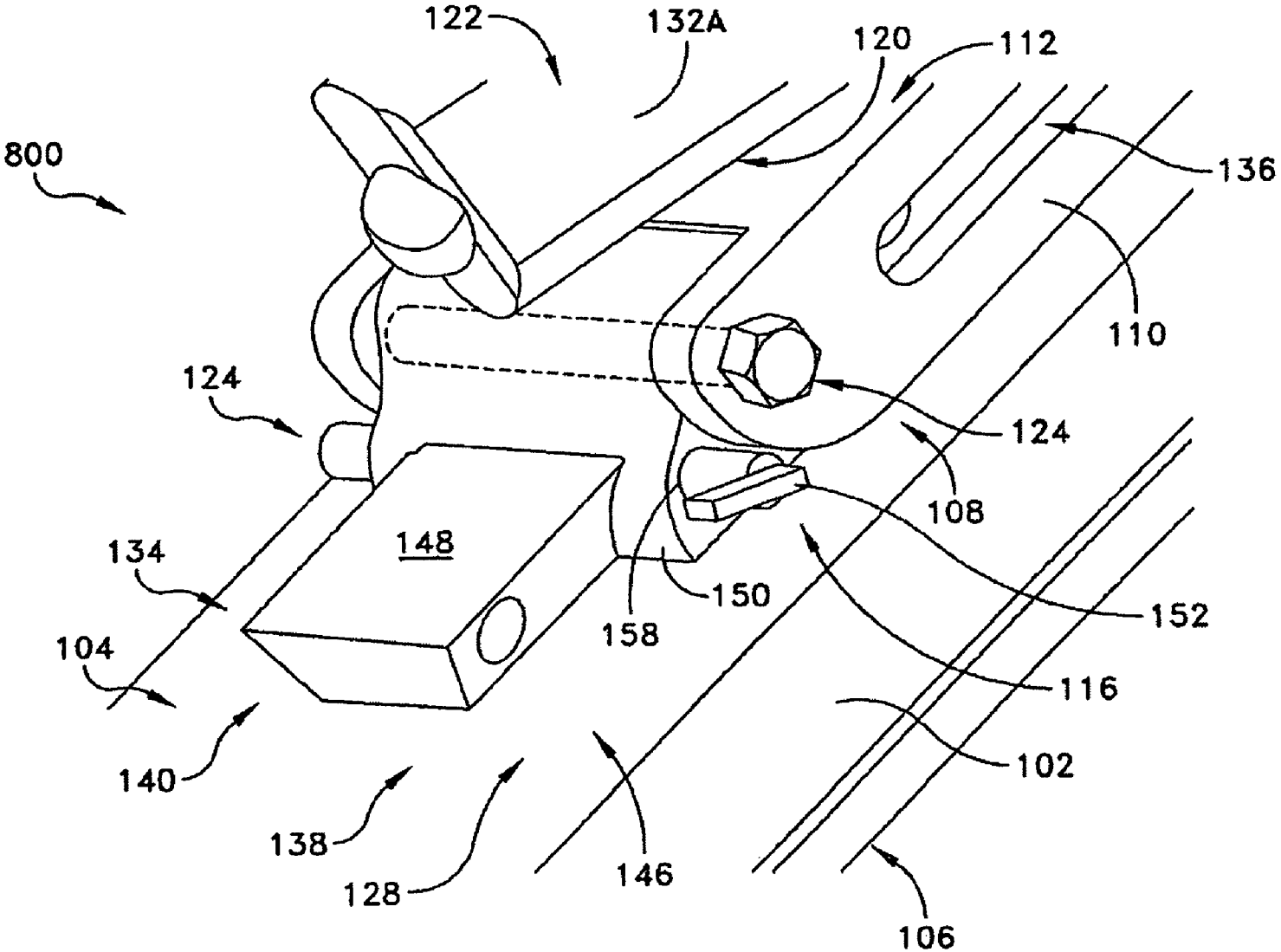
FIG. 8 illustrates the toe end of the system shown in FIGS. 1-7, in which the fixation device is disposed within a passageway of the slider portion and one of the passageways of the anchor plate.

Fixation device 152 generally allows selective positioning of slider 150 and along anchor plate 148. Slider 150 has a right side 154 and a left side 156. Slider 150 forms a passageway 158 between right side 154 and side 156. Anchor plate 148 has a right side 160 and a left side 162. Anchor plate 148 forms at least two passageways 164 (a.k.a. channels 148*c*)

between right side 160 and left side 162. A pin 166 (referred to broadly above as a fixation device 152) may be configured to extend through passageway 158 of slider 150 and one of the passageways 164 of anchor plate 148. This causes attachment of the first anchor portion 128 and first attachment portion 124 to one another with pin 166 disposed through one of the selected passageways 164A, 164B, 164C of anchor plate 148 and through passageway 158 of the slider 150. In another configuration, the position of alpine binding attachment plate 110 prevents attachment of second anchor portion 130 and second attachment portion 126 to one another when pin 166 is disposed through another passageway 164D of the anchor plate 148 and through passageway 158 of slider 150. FIG. 7 illustrates portion 700 with pin 166 inserted partially into a portion of passageway 158. FIG. 8 illustrates a portion 800 with pin 166 inserted completely into passageway 158.

Figure 15:
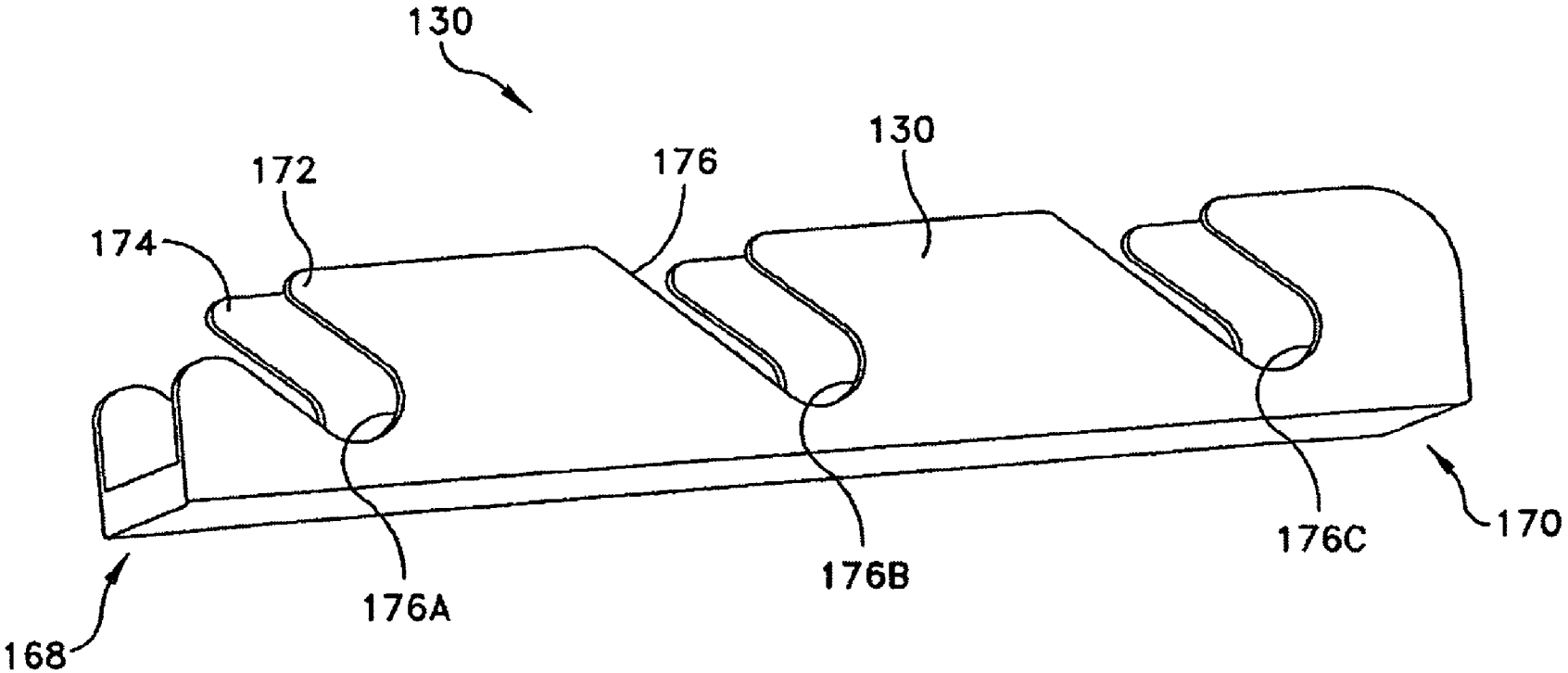
FIGS. 15 and 16 illustrate additional views of the anchor portion for placement at the heel end of the system.
Figure 16:
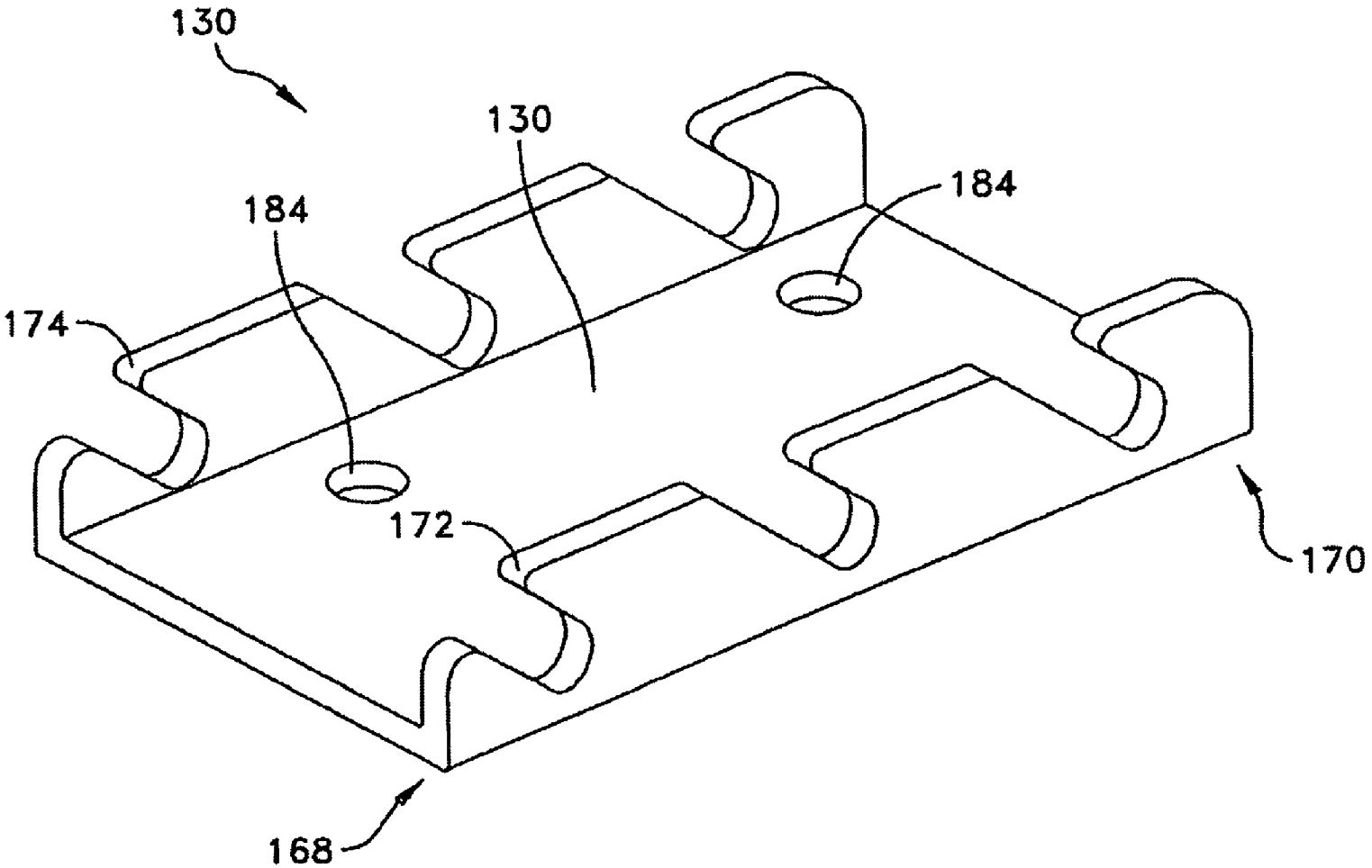

FIGS. 15 and 16 illustrate additional views of second anchor portion 130. Second anchor portion 130 may be positioned on ski 102 for selective engagement with second attachment portion 126 of alpine binding attachment plate 110. Second anchor portion 130 includes a toe end 168 and a heel end 170 in opposition to one another. Second anchor portion 130 includes a left side 172 and a right side 174 In opposition to one another. Second anchor portion 130 forms at least one opening 176 between the left side 172 and the right side 174. Openings 176 may be configured for retaining a crossbar 178 (FIG. 9) of second attachment portion 126 of alpine binding attachment plate 110. Openings 176 of second anchor portion 130 may include a series of slots 176A, 176B, and 176C for selective engagement of crossbar 178 of second attachment portion 126. Slots 176A, 176B, and 176C generally correspond with passageways 164A, 164B, and 164C. Second anchor portion 130 may also form a plurality of holes 184 for attachment to the ski 102.

In an embodiment, alpine binding attachment plate 110 may be pre-formed with holes or with an area for forming holes through top side 112. This allows attachment of the alpine ski boot binding 122 on a ski 102.

The various parts described herein may be formed of metal, carbon fiber, graphite, composites, plastics, other suitable material, combinations thereof, or the like. Moreover, the various parts may be formed by a single material or with various components formed from multiple different materials. In one embodiment, the material may be aluminum. In another embodiment, the metal may be plastic. In order to provide adequate strength, relatively low weight, and to conserve costs, the various parts, for example, alpine binding attachment plate 110, first attachment portion 124, second attachment portion 126, first anchor portion 128, and second anchor portion 130 may be constructed our of aluminum, a high density plastic, or another suitable single material. Alternatively, these components may be formed from different materials in order to provide adequate strength, relatively low weight, and to conserve costs. Moreover, while described as separate components attached to ski 102, risers 108 may be integrated with the top side of ski 102. Moreover, alpine binding attachment plate 110 may be integrated with risers 108 to make a unitary number with a pivotal riser plate.

In one embodiment, first anchor portion 128 may include a mechanical stop 182 for preventing slider 150 from extending beyond toe end 134 of anchor plate 148. Slider 150 may be configured with a specific cross-section. Anchor plate 148 may also have its own specific cross-section. The cross-section of slider 150 and the cross-section of anchor plate 148 may together form mechanical stop 182. This configuration may allow positioning of the passageway 158 of slider 150 to align with at least two of the at least two passageways 164 of anchor plate 148.

Figure 17:
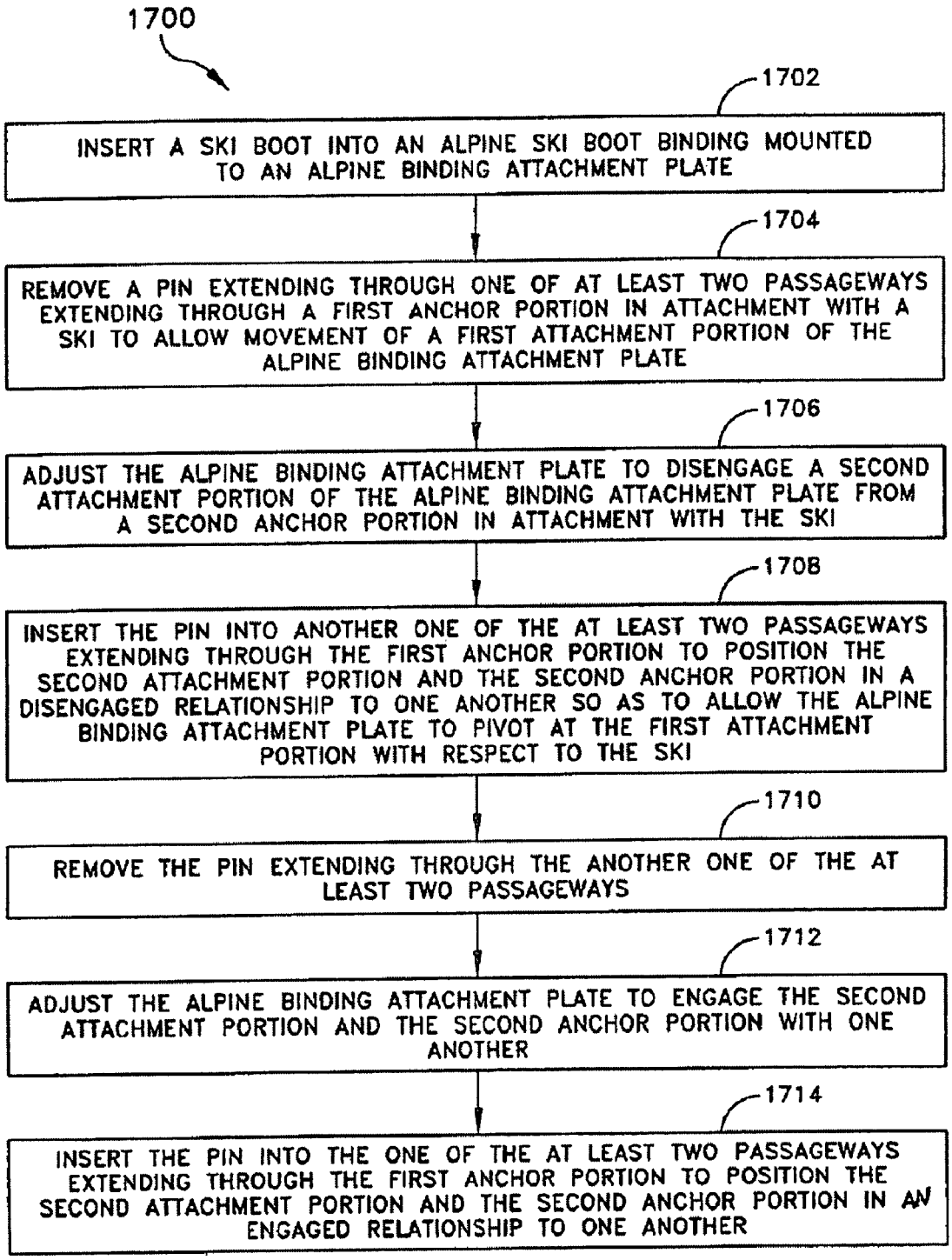
FIG. 17 is an exemplary flow chart illustrating a method of releasably locking a ski boot heel.

Referring now to FIG. 17, there is shown a method 1700 of releasably locking a ski boot heel. Method 1700 may include inserting 1702 a ski boot into an alpine ski boot binding mounted to an alpine binding attachment plate. This step is optional as the adjustment may be made with or without the ski boot mounted in the binding.

Next, method 1700 may include removing 1704 a pin extending through one of at least two passageways extending through a first anchor portion In attachment with a ski to allow movement of a first attachment portion of the alpine binding attachment plate. This may be followed by adjusting 1706 the alpine binding attachment plate to disengage a second attachment portion of the alpine binding attachment plate from a second anchor portion in attachment with the ski. As described above, the adjusting includes sliding the first anchor portion, i.e., slider 150, along anchor plate 148.

Once adjustment Is satisfactory, method 1700 may include inserting 1708 the pin into another one of the at least two passageways extending through the first anchor portion to position the second attachment portion and the second anchor portion in a disengaged relationship to one another so as to allow the alpine binding attachment plate to pivot at the first attachment portion with respect to the ski.

Method 1700 may further include removing 1710 the pin extending through the another one of the at least two passageways. This may be followed by adjusting 1712 (i.e. sliding as described above, but the adjustment may be via sliding or other mechanism) the alpine binding attachment plate to engage the second attachment portion and the second anchor portion with one another, Finally, method 1700 may also include inserting 1714 the pin Into the one of the at least two passageways extending through the first anchor portion to position the second attachment portion and the second anchor portion in an engaged relationship to one another. This prevents the alpine binding attachment plate from pivoting at the first attachment portion with respect to the ski.

Method 1700 may be repeated, reversed, or modified in order to switch between modes of use in which the heel of the skier's boot is locked down to a ski or allowed to pivot relative to a point adjacent to the toe of the skier's boot.

What is claimed is:

1. A selectively pivotal riser, comprising:

an alpine binding attachment plate having a top side and a bottom side in opposition to one another, a toe end and a heel end in opposition to one another, the top side providing an area for attaching an alpine ski boot binding thereon, a first attachment portion toward the toe end, and a second attachment portion toward the heel end;

a first anchor portion for pivotally attaching the first attachment portion thereto, and the first anchor portion configured for attachment with a ski, the first anchor portion comprising:

a toe end and a heal end in opposition to one another, a left side and a right side in opposition to one another, and an opening between the left side and the right side for retaining a shaft therein so as to allow pivotal attachment of the first attachment portion of the alpine binding attachment plate thereto; and a second anchor portion for selectively attaching the second attachment portion thereto, and the second anchor portion configured for attachment with the ski;

a horizontal adjustment mechanism for selectively adjusting the horizontal position of the second anchor portion with respect to the second attachment portion so as to selectively position the alpine binding plate with respect to the ski, the horizontal adjustment mechanism comprising an anchor plate for attachment to the ski, a slider portion for pivotal attachment to the alpine binding attachment plate, and a fixation device for selectively positioning the anchor plate and the slider with respect to one another wherein the slider has a right side and a left side, the slider forms a passageway between the right side and left side thereof, the anchor plate has a right side and a left side, the anchor plate forms at least two passageways between the right side and the left side thereof, and a pin is configured to extend through the passageway of the slider and one of the at least two passageways of the anchor plate so as to (1) cause attachment of the second anchor portion and the second attachment portion to one another with the pin disposed through one of the at least two passageways of the anchor plate and the passageway of the slider, and (2) prevent attachment of the second anchor portion and the second attachment portion to one another with the pin disposed through another one of the at least two passageways of the anchor plate and the passageway of the slider.

2. A selectively pivotal riser according to claim 1, wherein the alpine binding attachment plate comprises metal.

3. A selectively pivotal riser according to claim 1, wherein the alpine binding attachment plate comprise plastic.

4. A selectively pivotal riser according to claim 1, wherein the alpine binding attachment plate, the first attachment portion, the second attachment portion, the first anchor portion, and the second anchor portion are formed of a single material.

5. A selectively pivotal riser according to claim 1, wherein at least two of the alpine binding attachment plate, the first attachment portion, the second attachment portion, the first anchor portion, and the second anchor portion are formed of different materials than one another.

6. A selectively pivotal riser according to claim 1, wherein the first attachment portion includes a pair of passageways for retaining a shaft therein so as to allow the first anchor portion to pivotally attach thereto.

7. A selectively pivotal riser according to claim 1, wherein the second attachment portion includes a crossbar for selective engagement with the second anchor portion.

8. A selectively pivotal riser according to claim 1, wherein the first anchor portion and the second anchor portion are separate components from one another so as to allow selective mounting of the first anchor portion and the second anchor portion on the ski with respect to one another.

9. A selectively pivotal riser according to claim 1, wherein the first anchor portion includes a horizontal adjustment mechanism for selectively adjusting the horizontal position of the second anchor portion with respect to the second attachment portion so as to selectively position the alpine binding plate with respect to the ski.

10. A selectively pivotal riser according to claim 1, wherein the slider and the alpine binding attachment plate are attached to one another with a shaft, the slider and the anchor plate are attached to one another with the fixation device, and the fixation device allows selective positioning of the slider and the anchor plate while skiing.

11. A selectively pivotal riser according to claim 1, wherein the first anchor portion includes a mechanical stop for preventing the slider from extending beyond the toe end of the anchor plate.

12. A selectively pivotal riser according to claim 1, wherein the second anchor portion is positioned on the ski for selective engagement with the second attachment portion of the alpine binding attachment plate.

13. A selectively pivotal riser according to claim 2, wherein the metal is aluminum.

14. A selectively pivotal riser, comprising:

an alpine binding attachment plate having a top side and a bottom side in opposition to one another, a toe end and a heel end in opposition to one another, the top side providing an area for attaching an alpine ski boot binding thereon, a first attachment portion toward the toe end, the first attachment portion including a first retention device for retaining the first attachment portion to a first anchor portion, a second attachment portion toward the heel end, the second attachment portion including a second retention device for retaining the second attachment portion to the second anchor, and the alpine binding attachment plate configured for (1) attaching a toe portion of the alpine ski boot binding toward the toe end thereof, and (2) for attaching a heel portion of the alpine ski boot binding toward the heel end thereof;

the first anchor portion for pivotally attaching the first retention device retained by the first attachment portion thereto, and the first anchor portion (1) in attachment with the top surface of a ski, (2) positioned on the ski for selective engagement with the first attachment portion of the alpine binding attachment plate, (3) including a toe end and a heel end in opposition to one another, (4) including a left side and a right side in opposition to one another, (5) forming an opening between the left side and the right side for retaining the first retention device therein so as to allow pivotal attachment of the first attachment portion of the alpine binding attachment plate thereto, (6) including a horizontal adjustment mechanism for selectively adjusting the horizontal position of the second anchor portion with respect to the second attachment portion so as to selectively position the alpine binding plate with respect to the ski, the horizontal adjustment mechanism including (a) an anchor plate for attachment to the ski, (b) a slider portion for pivotal attachment to the alpine binding attachment plate, and (c) a fixation device for selectively positioning the anchor plate and the slider with respect to one another, the slider and the alpine binding attachment plate attached to one another with a shaft, the slider and the anchor plate attached to one another with the fixation device, and the fixation device allowing selective positioning of the slider and the anchor plate while skiing, the slider having a right side and a left side, the slider forming a passageway between the right side and left side thereof, the anchor plate having a right side and a left side, the anchor plate forming at least two passageways between the right side and the left side thereof, and the fixation device configured to extend through the passageway of the slider and one of the at least two passageways of the anchor plate so as to (x) cause attachment of the second anchor portion and the second attachment portion to one another with the fixation device disposed through one of the at least two passageways of the anchor plate and the passageway of the slider, and (y) prevent attachment of the second anchor portion and the second attachment portion to one another with the fixation device disposed through another one of the at least two passageways of the anchor plate and the passageway of the slider; and the second anchor portion for selectively attaching the second attachment portion thereto, and the second anchor portion (1) in attachment with the top surface of a ski, (2) positioned on the ski for selective engagement with the second attachment portion of the alpine binding attachment plate, (3) including a toe end and a heel end in opposition to one another, includes a left side and a right side in opposition to one another, and (4) forming at least one opening between the left side and the right side for retaining a crossbar of the second attachment portion of the alpine binding attachment plate, and the at least one opening of the second anchor portion forming a series of slots for selective engagement of the second retention device of the second attachment portion;

wherein the first anchor portion and the second anchor portion allow selective mounting of the first anchor portion and the second anchor portion on the ski with respect to one another.

* * * * *